United States Patent [19]

Okawa et al.

[11] 4,055,031

[45] Oct. 25, 1977

[54] GASKET CONSTRUCTION

[75] Inventors: Taro Okawa, Tokyo; Hideichi Takeda, Ichikawa, both of Japan

[73] Assignee: Yoshida Kogyo K.K., Tokyo, Japan

[21] Appl. No.: 678,952

[22] Filed: Apr. 21, 1976

[30] Foreign Application Priority Data

Apr. 22, 1975 Japan ..... 50-54796
June 25, 1975 Japan ..... 50-89925

[51] Int. Cl.[2] ..... E04C 2/34

[52] U.S. Cl. ..... 52/172; 52/398; 52/616; 428/34

[58] Field of Search ..... 52/172, 304, 397–403, 52/616, 171, 398; 428/34

[56] References Cited

U.S. PATENT DOCUMENTS

| | | | |
|---|---|---|---|
| 3,363,390 | 1/1968 | Crane et al. | 52/403 |
| 3,872,198 | 3/1975 | Britton | 428/34 |
| 3,875,706 | 4/1975 | Okawa | 52/616 |

FOREIGN PATENT DOCUMENTS

| | | | |
|---|---|---|---|
| 551,850 | 1/1958 | Canada | 52/399 |

*Primary Examiner*—James L. Ridgill, Jr.
*Attorney, Agent, or Firm*—Hill, Gross, Simpson, Van Santen, Steadman, Chiara & Simpson

[57] ABSTRACT

A gasket construction for mounting a plurality of panes or panel members within a frame comprises a gasket member having a one-piece body, and a desiccant material incorporated in the one-piece body. The gasket body has at least one spacer wall section formed integrally therewith to provide a plurality of continuous peripheral grooves for receiving the panel members in parallel, closely spaced planes with an enclosed space formed therebetween. Means are provided for communicating the desiccant material with the enclosed space or spaces to prevent the generation and presence of condensation on the interior surfaces of the panel members.

7 Claims, 5 Drawing Figures

GASKET CONSTRUCTION

BACKGROUND OF THE INVENTION

1. Field of the Invention

This invention relates generally to gaskets and more particularly to a gasket construction for mounting panel members, such as glass panels within a frame such as a sash frame to provide a multiple-glazed construction.

Still more specifically, this invention deals with a gasket construction of the type described which is provided with means for ensuring that enclosed spaces between the frames or panel members be kept dry so as to prevent condensation on the interior surfaces of the panel members.

2. Prior Art

In the art of thermally insulated and/or acoustical multiple-glazed windows, the focus has been to provide an effective gasket means whereby the joint between the panel members and the frame is sealed against the passage of air, water and/or sound therebetween.

Conventional gasket constructions for the above application generally comprise a resilient gasket member having a continuous groove therein for receiving the peripheral edges of the panel members, and perimeter spacer members interposed between the marginal edges of the panel members to hold the latter in parallel, closel spaced planes. In the construction of the prior art multiple-glazed windows, it has been frequently required to utilize a separate, preformed multiple-glazed unit with the aforesaid conventional gasket assembly. Such a separate multiple-glazed unit usually includes a frame peripherally embracing the resilient gasket member whereby the unit can be installed in a sash frame to provide a multiple-glazed window. This requirement arises out of the fact that it is somewhat difficult to install the panel members relative to the sash frame as a result of having to employ the conventional gasket assembly. Such conventional multiple-glazed windows are undesirable, however, in that considerable time is required to assemble such separate multiple-glazed units.

The problem of condensation on the surfaces of the adjacent panel members is a serious one, particularly when a thermally insulated multiple-glazed window is installed in a cold climate where extreme interior and exterior temperature differentials may prevail. It has been known in the art to employ a desiccant material in a multiple-glazed window for the purpose of keeping the enclosed insulating spaces dry. In certain prior art multiple-glazed windows of this type, a bag or bags filled with a desiccant material are disposed in a continuous chamber or opening defined by perimeter spacer members interposed between the marginal edges of the panel members, and other members structurally associated therewith, the chamber having one or more apertures in communication with the enclosed spaces to protect the same against the penetration of humidity. This arrangement has not been found wholly satisfactory, however, in that relatively high installation costs are entailed by such component parts.

SUMMARY OF THE INVENTION

It is therefore an object of the present invention to provide an improved gasket construction for multiple-glazed windows which permits easy and quick installation of panel members in a sash frame or the like.

Another object is to provide an improved gasket construction whereby the panel members can be mounted in the sash frame in parallel, closely spaced planes without the need for any separate spacer member.

A further object is to provide an improved gasket construction which incorporates means for ensuring that enclosed insulating spaces between the panel members are kept dry.

According to the present invention, there is provided a gasket construction for mounting a plurality of panel members within a frame which gasket construction comprises a gasket member having a one-piece body. The gasket body has a pair of parallel spaced, opposed side walls and a peripheral wall interconnecting the side walls to define a continuous channel of a substantially U-shaped cross section. The gasket body also includes a partition wall extending transversely between the side walls in spaced apart relationship to the peripheral wall to form a continuous opening. The partition wall has at least one integrally formed peripheral spacer wall section extending therefrom in parallel relationship to the side walls to form a plurality of continuous peripheral grooves for receiving the panel members in parallel, closely spaced planes with an enclosed space formed therebetween. A desiccant material is filled in the continuous opening. Means are provided for communicating the desiccant material with the enclosed space or spaces to prevent the generation and presence of condensation on the interior surfaces of the panel members.

Many other advantages and features of the present invention will become manifest to those versed in the art upon making reference to the detailed description and the accompanying sheets of drawings in which preferred embodiments incorporating principles of the present invention are shown by way of illustrative example.

DESCRIPTION OF THE PREFERRED EMBODIMENTS

Figure 1:
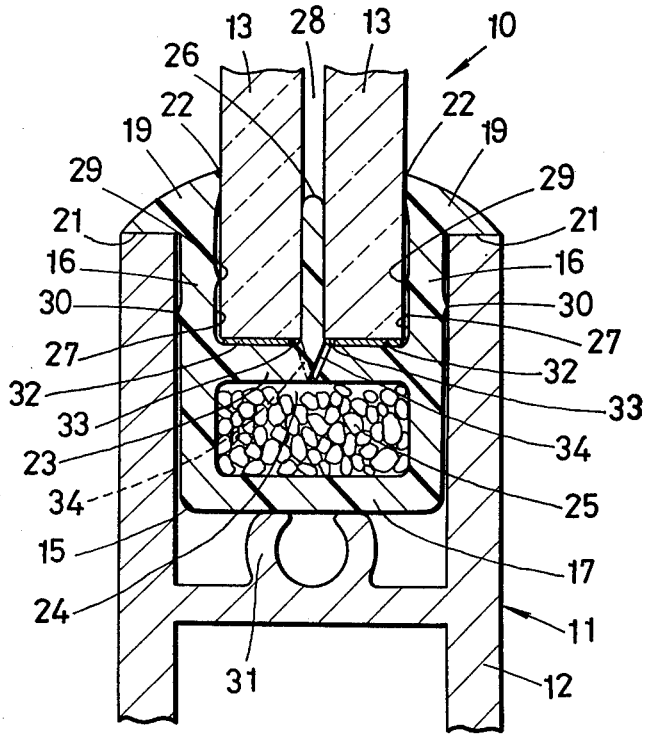
FIG. 1 is a cross-sectional view of a portion of a double-glazed window, showing a gasket construction according to a preferred embodiment of the present invention installed in a sealing position.

A double-glazed window which is partially shown and generally designated at 10 in FIG. 1 includes a sash frame 11 which is comprised essentially of four frame members 12 of substantially H-shaped cross section joined together at their ends to define a rectangular opening in which a pair of panel members 13, 13 such as panels or panes of glass are mounted by means of a gasket member 14 (FIG. 2) embodying the principles of the present invention.

Figure 2:
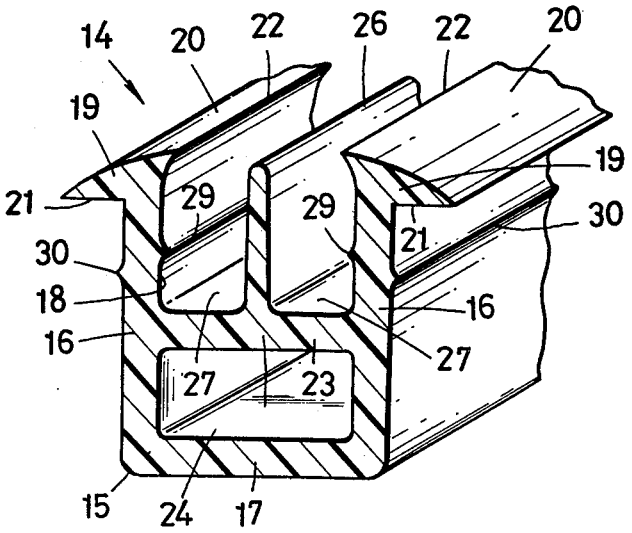
FIG. 2 is a fragmentary, perspective view of the gasket member of FIG. 1.

As best shown in FIG. 2, the gasket member 14 includes a one-piece body 15 having a pair of parallel spaced, opposed side walls 16, 16 and a peripheral wall 17 interconnecting the side walls 16, 16 to define a continuous channel 18 of substantially U-shaped cross section. The gasket body 15 is made of an extruded elastomeric material or any suitable resilient synthetic resin. Each of the side walls 16, 16 has an outwardly directed flange 19 formed at its upper or distal end, which flange has an arcuately shaped outer surface 20 and a planar undersurface 21 extending at right angle to the plane of each side wall 16 for abutting engagement with the inner peripheral edge of the sash frame 11 as shown in FIG. 1. The inner edges of the flanges 19, 19 are inwardly directed toward each other to provide lip portions 22, 22 for sealing engagement with the exterior surfaces of the glass panels 13, 13.

The gasket body 15 also includes a partition wall 23 extending transversely between the side walls 16, 16 in spaced apart relationship to the peripheral wall 17 to form a continuous opening or passage 24 in which a desiccant material 25 is filled.

The partition wall 23 has an integrally formed spacer wall section 26 extending therefrom in parallel spaced relationship to the opposed side walls 16, 16 and disposed intermediate thereof to form a pair of peripheral panel receiving grooves 27, 27. The spacer wall section 26 is slightly shorter in cross-section than the side walls 16, 16 and is substantially thinner. The glass panels 13, 13 received in the grooves 27, 27 are held in parallel, closely spaced planes by the spacer wall section 26 to provide an enclosed insulating space 28 therebetween of about 1 mm or greater to effect sound transmission loss and heat transfer reduction through the double-glazed window 10.

The side walls 16, 16 have a pair of oppositely directed first sealing ridges 29, 29 extending longitudinally along their confronting interior surfaces, the sealing ridges 29, 29 being disposed approximately centrally of the depth of the panel receiving grooves 27, 27. A pair of longitudinal second sealing ridges 30, 30 are similarly formed on the exterior surfaces of the side walls 16, 16, the second sealing ridges 30, 30 being disposed at a level illustrated below the first sealing ridges 29, 29.

The gasket member 14 is shown in FIG. 1 installed in a sealing position within the sash frame 11 with the undersurface of the peripheral wall 17 in abutting engagement with a chase 31 which is provided to receive fasteners (not shown) to unite a window assembly together. In this condition, the sealing lip portions 22, 22 and the first sealing ridges 29, 29 are held in deformed sealing engagement with the exterior surfaces of the glass panels 13, 13, and the second sealing ridges 30, 30 with the opposed interior surfaces of the side walls of the frame members 12.

As shown in FIG. 1, an air-impermeable element 32 is interposed between the peripheral edge of each glass panel 13 and the bottom face of each panel receiving groove 27, the element 32 being so dimensioned as to provide a continuous space 33 on each side of the spacer wall section 26 adjacent the partition wall 23.

The partition wall 23 is apertured as at 34 at predetermined intervals to permit the continuous spaces 33 to communicate with the continuous opening 24. The spacer wall section 26 is also removed at predetermined spaced regions along the length thereof to permit the contiunuous opening 24 in which the desiccant material 25 is disposed to communicate with the enclosed insulating space 28 via the apertures 34 and the continuous spaces 33. This arrangement ensures that the insulating space 28 is always kept dry to prevent the generation and presence of condensation on the interior surfaces of the glass panels 13, 13.

Figure 3:
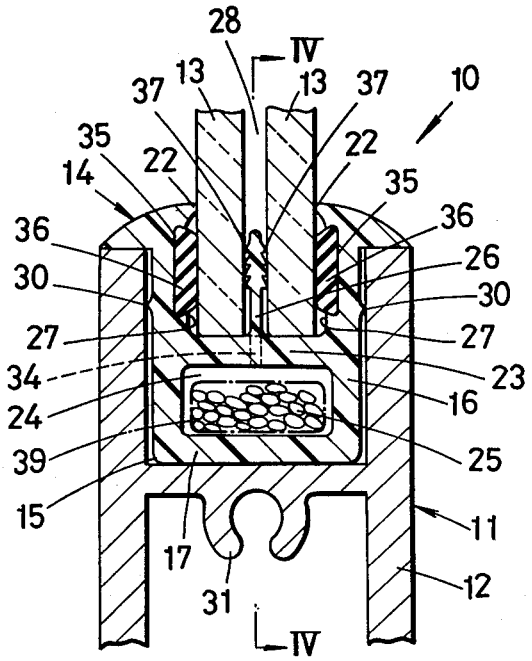
FIG. 3 is a cross-sectional view similar to FIG. 1, but showing a gasket construction according to another embodiment of the invention.
Figure 4:
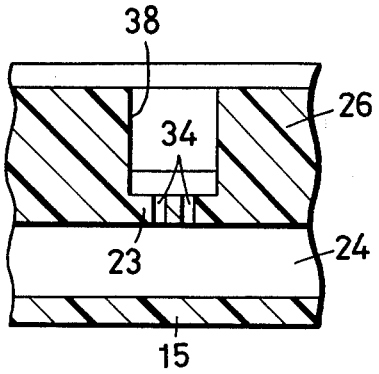
FIG. 4 is a cross-sectional view of the gasket member taken along line IV—IV of FIG. 3.
Figure 5:
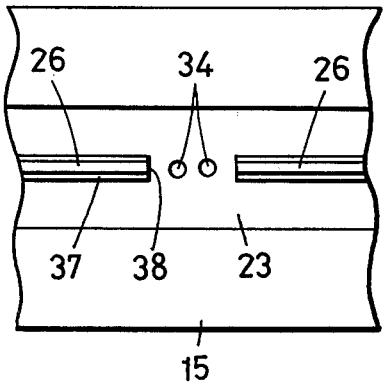
FIG. 5 is a top plan view of the gasket member of FIG. 3.

FIGS. 3 to 5 inclusive illustrate a modification of the embodiment shown in FIGS. 1 and 2. In this embodiment, each of the side walls 16, 16 has a longitudinal recess 35 of generally trapezoidal cross-section formed in and extending along its interior surface for receiving a sealing element 36 made of air-impermeable material such as butyl rubber. As shown in FIG. 3, the sealing element 36 is also cross-sectionally trapezoidal and hence is formed wider across at its portion at the bottom of the recess 35, which portion is complementary in shape to the longitudinal recess 35 so that the former can be snapped into engagement with the latter. Also, the spacer wall section 26 is provided on each side of its distal half portion, illustrated as its upper half portion with a plurality of ribs 37 extending therealong to provide a positive seal between each side of the spacer wall section 26 and the interior surfaces of the glass panels 13, 13. The desiccant material 25 is encapsuled as at 39 with any suitable air-permeable material to facilitate the insertion thereof in the gasket body 15.

In this embodiment, communication of the continuous opening or passage 24 with the enclosed insulating space 28 is provided by a pair of apertures 34 in the partition wall 23 at predetermined intervals, with the spacer wall section 26 removed as at 38 in a manner to maintain the apertures 34 in direct communication with the insulating space 28 as best shown in FIG. 4. This arrangement obviates the need for the continuous spaces 33 in the preceding embodiment and hence for the need for the air-impermeable elements 32.

Since the gasket body is of one-piece construction and the dessicant material is incorporated in the gasket body, no complicated operation is needed for mounting the panel members relative to the sash frame to provide a multiple-glazed window.

While the gasket construction according to this invention has been specifically shown and described herein, the invention itself is not to be restricted by the exact showing of the drawing or the description thereof. For example, the spacer wall section 26 can be displaced from a plane intermediate of the width of the channel 18 so that a pair of glass panels of unequal thickness can be mounted in the sash frame 11. Also, two or more spacer wall sections 26 can be provided so that three or more glass panels can be mounted in the sash frame 11 to achieve a better sound transmission loss through the multiple-glazed window 10.

Although other various minor modifications might be suggested by those versed in the art, it should be understood that we wish to embody within the scope of the patent warranted hereon, all such embodiments as reasonably and properly come within the scope of our contribution to the art.

We claim as our invention:

1. A gasket construction for mounting a plurality of panel members within a rigid frame, said gasket construction comprising:

A one-piece flexible body having a pair of parallel spaced opposed sidewalls, and a peripheral wall interconnecting said sidewalls to define a continuous channel of substantially U-shaped cross-section, said flexible body having a partition wall extending transversely between said sidewalls in spaced apart substantially parallel relationship to said peripheral wall to form a continuous opening for receiving dessicant, at least one peripheral spacer wall section extending integrally from said partition wall in parallel spaced relation to said sidewalls, so that a plurality of continuous peripheral grooves are provided for receiving the panel members in parallel closely spaced planes with an enclosed space formed therebetween, and passage means in said partition wall and said spacer wall section for communicating said continuous opening with the enclosed space.

2. A gasket construction according to claim 1 wherein each of said opposed sidewalls has an outwardly directed lip portion at its distal end, one side of each said lip being flat for engaging an edge of the frame, and the other side having a shape adapted to blend the surface of one of the panel members with a side of the frame.

3. A gasket construction according to claim 1 wherein each of said sidewalls has a longitudinal first sealing ridge extending along its interior surface and a longitudinal second sealing ridge extending along its exterior surface remotely from its distal edge for engagement with the frame.

4. A gasket construction according to claim 1 wherein said spacer wall section is provided on each side of its distal half portion with a plurality of ribs extending therealong.

5. A gasket construction according to claim 1 further including a pair of separate sealing elements; each of said side walls having a longitudinal recess formed in and extending along its interior surface and respectively receiving said sealing elements.

6. A gasket construction according to claim 1 wherein said communicating means is a plurality of passages extending through said partition wall and the base of said spacer wall section at longitudinally spaced intervals.

7. A gasket constructions according to claim 1 having a dessicant material disposed directly in said continuous opening.

* * * * *